United States Patent [19]

Miller et al.

[11] Patent Number: 4,957,416

[45] Date of Patent: Sep. 18, 1990

[54] GAS COMPRESSOR

[75] Inventors: Bernard F. Miller, Corning, N.Y.; John A. Sawyer, Trout Run, Pa.

[73] Assignee: Dresser-Rand Company, Corning, N.Y.

[21] Appl. No.: 405,249

[22] Filed: Sep. 11, 1989

[51] Int. Cl.[5] ..... F04B 5/00; F04B 27/04

[52] U.S. Cl. ..... 417/273; 91/493; 92/72; 92/138; 417/266

[58] Field of Search ..... 417/266, 273; 92/72, 92/138; 91/493, 496

[56] References Cited

U.S. PATENT DOCUMENTS

| | | | |
|---|---|---|---|
| 224,950 | 2/1880 | Prosser | 91/493 X |
| 999,518 | 8/1911 | Peck | 92/74 X |
| 1,456,089 | 5/1923 | Baker | 92/138 X |
| 2,673,028 | 3/1954 | Cornelius | 417/266 X |
| 3,692,434 | 9/1972 | Schnear | 417/273 X |
| 4,729,291 | 3/1988 | Miller | 92/138 |

FOREIGN PATENT DOCUMENTS

| | | | |
|---|---|---|---|
| 149604 | 5/1937 | Austria | 417/273 |
| 1210 | of 1872 | United Kingdom | 91/493 |
| 10282 | of 1885 | United Kingdom | 417/273 |

*Primary Examiner*—Robert G. Nilson
*Attorney, Agent, or Firm*—Bernard J. Murphy

[57] ABSTRACT

The Compressor comprises three stages of compression, having three cylinders, each of the latter having a piston reciprocable therein. Two of the pistons are in-line along a common axis, and the cylinders therefor are in confronting relationship. The third cylinder lies along an axis which traverses the two-piston axis. All three pistons are reciprocated by two connecting rods, in that the in-line pistons are joined by tie rods. Both connecting rods are coupled to the single crank of a crankshaft which is journalled in a crankcase, and all three cylinders are removably bolted to the crankcase.

9 Claims, 1 Drawing Sheet

GAS COMPRESSOR

This invention pertains to gas compressors, and in particular to reciprocating, high-speed, compact, and lightweight gas compressors capable of providing air or other gases at pressures to fifty-five hundred PSIG or more.

Most reciprocating compressors designed for high pressures, and small flow, are large, heavy and cumbersome.

It is an object of this invention to set forth a gas compressor that is extremely small in size, and very lightweight, approaching nineteen pounds total weight, and to provide a design that is easily assembled and disassembled for maintenance. An object, as well, is to set forth a gas compressor designed for, albeit not limited to, on-board aircraft application.

Particularly is it an object of this invention to disclose a gas compressor comprising a crankcase; three cylinders, removably fastened to said crankcase, opening onto said crankcase; a piston reciprocably disposed in each of said cylinders; means for admitting gas into, and discharging gas from, each of said cylinders; a crankshaft, having only a single crank, journalled in said crankcase; first rod means connected to two of said pistons; and second rod means connected to the other of said pistons; wherein both said first and second rod means are coupled to said single crank to cause coincident reciprocation of said three pistons.

Figure 1:
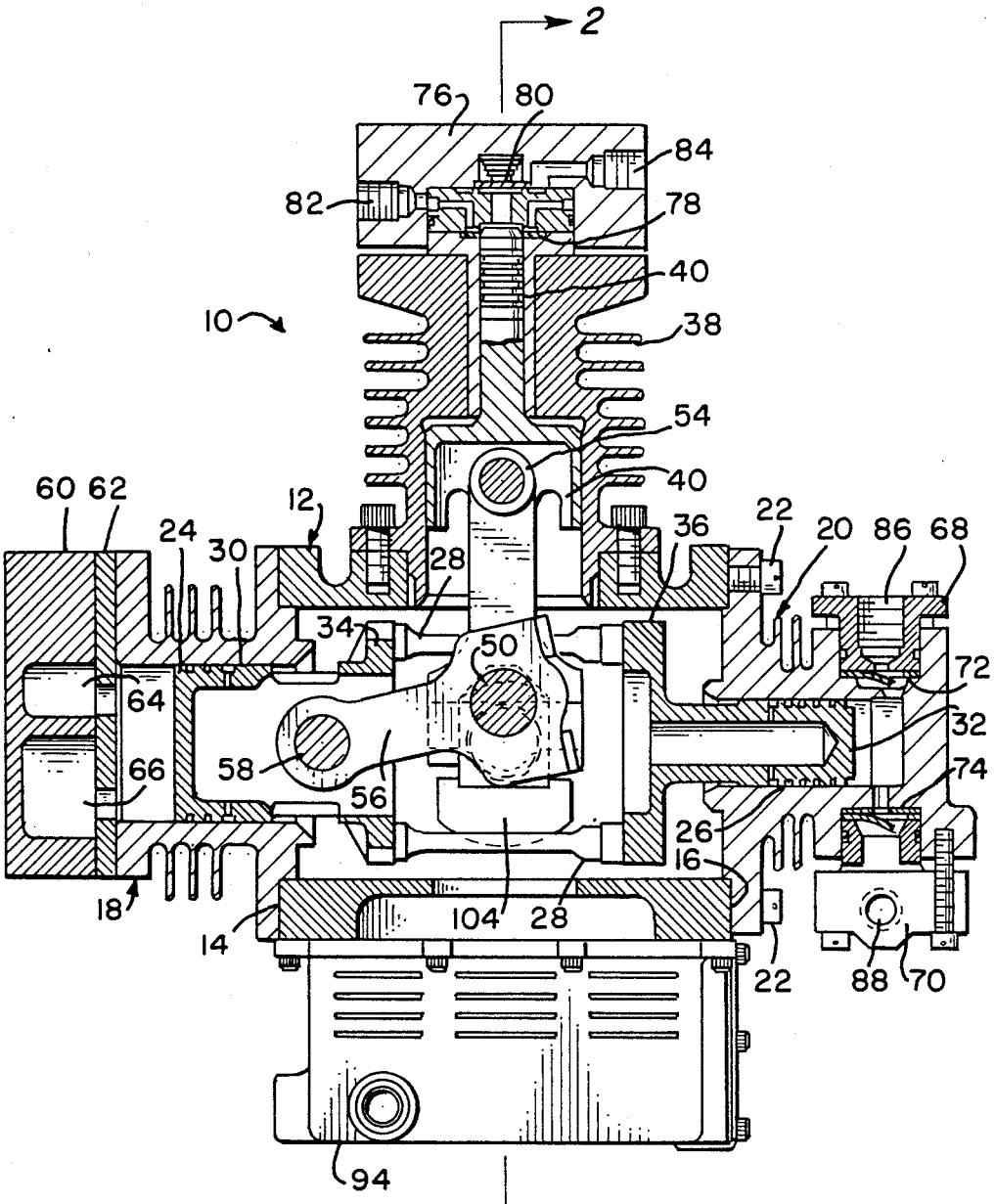
Figure 2:
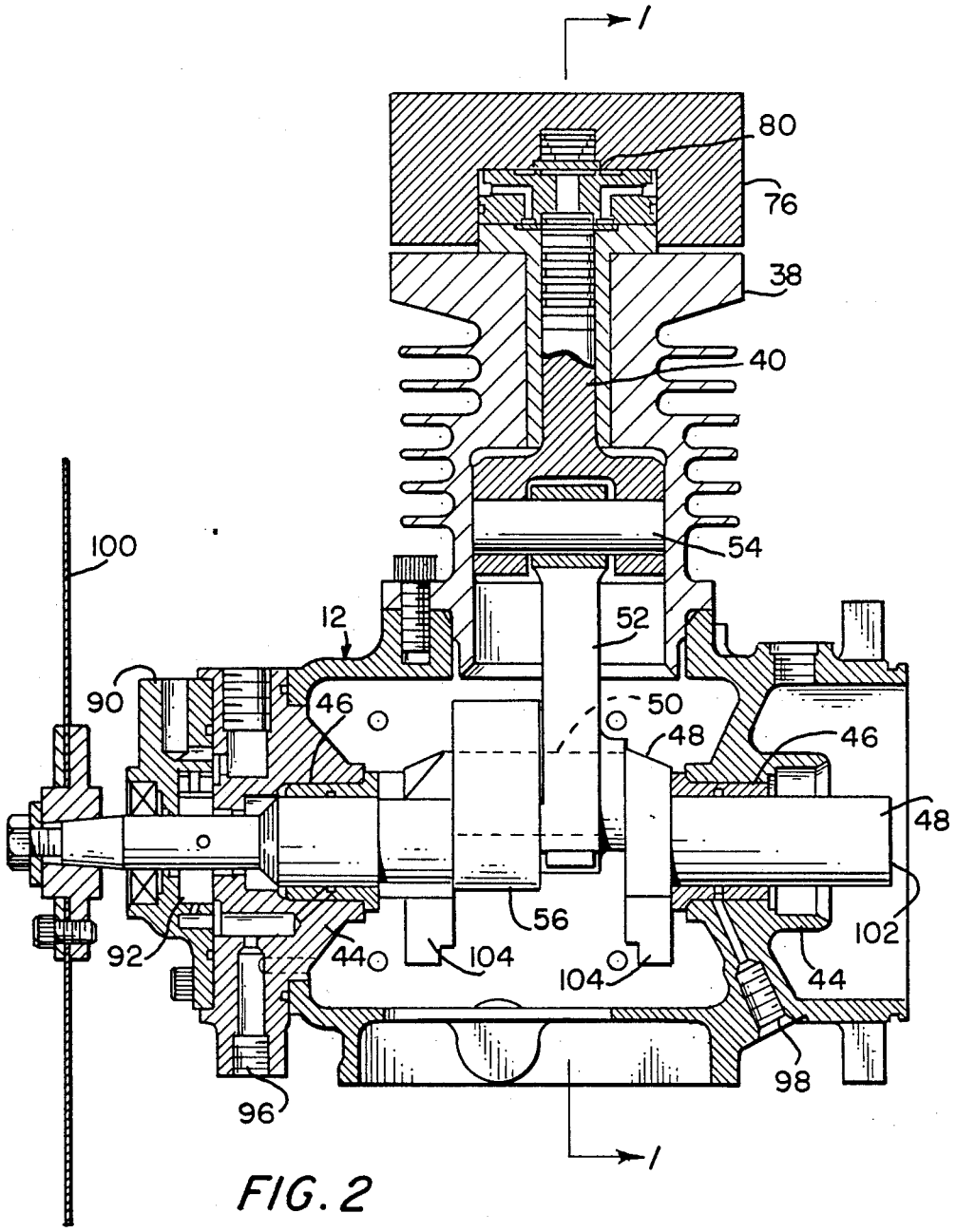

Further objects of this invention, as well as the novel features thereof, will become more apparent by reference to the following description, taken in conjunction with the accompanying figures, in which:

FIG. 1 is a cross-sectional view of a gas compressor, according to an embodiment thereof, taken along section 1—1 of FIG. 2; and FIG. 2 is a cross-sectional view of the gas compressor of FIG. 1 taken along section 2—2 of FIG. 1.

As shown in the figures, the gas compressor 10 embodying the invention has a crankcase 12. The crankcase 12 is open at opposite ends 14 and 16 thereof, and cylinders 18 and 20 are removably fastened thereto by mounting bolts 22 (only two of such being shown). Cylinders 18 and 20 have pistons 24 and 26 reciprocably disposed therein, respectively. Four, identical tie rods 28 fasten the pistons 24 and 26 together into a unitized assembly. Pistons 24 and 26 each have a head 30 and 32, and skirts or flanges 34 and 36, respectively, at the bases thereof. The tie rods 28 are fastened to the skirts or flanges 34 and 36, strengthening and stiffening the unitized assembly.

Intermediate the ends thereof, the crankcase 12 has a top opening to which a third cylinder 38 is removably bolted. Cylinder 38 has a third piston 40 reciprocably disposed therein. The crankcase has bearing housings 42 and 44 which have sleeve bearings 46 therein. A crankshaft 48, which has only one crank 50, is journalled in said bearings 46. A connecting rod 52 is coupled to the crank 50 and to the piston 40 via a piston pin 54. A second connecting rod 56 is coupled to the one crank 50, also, and to piston 24 via a pin 58. Consequently, with rotation of the crankshaft 48, all three pistons 24, 26 and 40 reciprocate in their respective cylinders coincidentally.

As disclosed, by way of example, the compressor 10 is a three-stage machine in which cylinder 18 and piston 24 comprise a first stage, cylinder 20 and piston 26 comprise a second stage, and cylinder 38 and piston 40 comprise the third stage. Cylinder 18 has housing 60 fastened thereto, with a valve plate 62, with gas inlet and discharge passages 64 and 66 formed therein. Cylinder 20 has recesses in which, removably bolted, are inlet and discharge valve housings 68 and 70. The housings 68 and 70 have flapper-type valves 72 and 74 therein. Valve plate 62 similarly has like valves thereat (albeit not shown). Cylinder 38 too has valve housing 76 bolted thereto; housing 76 has inlet and discharge valves 78 and 80 therein, as well as inlet and discharge ports 82 and 84. The housings 68 and 70 each have a port therein; port 86 for gas admittance, and port 88 for gas discharge.

To one side of the crankcase 12 is fastened an oil pump housing 90, the same having an oil pump 92 mounted therein and coupled to the crankshaft 48. Too, an oil sump 94 is coupled to the bottom of the crankcase 12. Oil injection passages, such as passages 96 and 98 (only these two being shown), receive pressured oil from the pump 92 via piping (not shown) to lubricate the moving components of the compressor 10. Similarly, piping (not shown) communicates between the inlet and discharge housings of the cylinders to effect the three-stage compression of the gas. For cooling of the compressor 10, a fan 100 is mounted on the end of the crankshaft 48, in adjacency to the oil pump housing 90, opposite the driven end 102 of the crankshaft.

The compressor occupies a very limited space, and due to the minimum of parts, is very light in weight. The housings and cylinders are easily removable for maintenance and servicing. All three pistons are driven off the one crank 50, and the pistons 24 and 26, due to the unitizing thereof by the tie rods 28, have no crossheads. By eliminating crossheads the space requirements for the pistons 24 and 26 are greatly reduced. The single crank 50 has a pair of counterweights 104 for proper balancing of the compressor.

While we have described our invention in connection with a specific embodiment thereof, it is to be clearly understood that this is done only by way of example, and not as a limitation to the scope of the invention as set forth in the objects thereof and in the appended claims.

We claim:

1. A gas compressor, comprising:

a crankcase;

three cylinders, removably fastened to said crankcase, opening onto said crankcase;

a piston, reciprocably disposed, in each of said cylinders;

means for admitting gas into, and discharging gas from, each of said cylinders;

a crankshaft, having only a single crank, journalled in said crankcase;

first rod means connected to two of said pistons; and second rod means connected to the other of said pistons; wherein both said first and second rod means are coupled to said single crank to cause coincident reciprocation of said three pistons;

said first rod means comprises (a) a connecting rod, and (b) tie rods fastening said two of said pistons together;

said two of said pistons each has a head and a base, and at said base thereof, a radially-extending flange or skirt; and said tie rods are fastened, at opposite ends thereof, to said flanges or skirts of said two of said pistons.

2. A gas compressor, according to claim 1, wherein:

a pair of said cylinders are mutually opposed and in-line along a given axis which traverses said crankcase; and said pair of cylinders are removably fastened, as aforesaid, to opposite, axial ends of said crankcase.

3. A gas compressor, according to claim 2, wherein:

said two of said pistons are reciprocably disposed in said pair of cylinders.

4. A gas compressor, according to claim 2, wherein:

a third cylinder is removably fastened, as aforesaid, to said crankcase intermediate the axial ends thereof.

5. A gas compressor, according to claim 4, wherein:

a third piston is reciprocably disposed in said third cylinder for translation along a reciprocation axis; and said reciprocation axis traverses said given axis.

6. A gas compressor, according to claim 1, wherein:

said tie rods are four in number, and are fastened to said flanges or skirts to define an open framework of said rods; and said single crank is centralized in said framework.

7. A gas compressor, according to claim 6, wherein:

said crankshaft traverses said framework.

8. A gas compressor, according to claim 1, wherein:

each of said cylinders has an inside diameter which differs from the others thereof.

9. A gas compressor, according to claim 1, wherein:

said gas admitting and discharging means comprises housings separately mounted to each of said cylinders.

* * * * *